US010626787B2

(12) United States Patent
Morton

(10) Patent No.: US 10,626,787 B2
(45) Date of Patent: Apr. 21, 2020

(54) UNIFLOW ENGINE WITH INTAKE AND/OR EXHAUST VALVES

(71) Applicants: VOLVO TRUCK CORPORATION, Göteborg (SE); Richard Kellogg Morton, Hagerstown, MD (US)

(72) Inventor: Richard Kellogg Morton, Hagerstown, MD (US)

(73) Assignee: Volvo Truck Corporation, Göteborg (SE)

( * ) Notice: Subject to any disclaimer, the term of this patent is extended or adjusted under 35 U.S.C. 154(b) by 52 days.

(21) Appl. No.: 15/775,286

(22) PCT Filed: Dec. 4, 2015

(86) PCT No.: PCT/US2015/064021

§ 371 (c)(1),
(2) Date: May 10, 2018

(87) PCT Pub. No.: WO2017/095441

PCT Pub. Date: Jun. 8, 2017

(65) Prior Publication Data

US 2018/0328263 A1 Nov. 15, 2018

(51) Int. Cl.
*F02B 25/08* (2006.01)
*F02D 9/04* (2006.01)
(Continued)

(52) U.S. Cl.
CPC ..... *F02B 25/08* (2013.01); *F01L 5/06* (2013.01); *F02B 25/02* (2013.01); *F02B 25/04* (2013.01); *F02B 75/02* (2013.01); *F02B 75/282* (2013.01); *F02D 9/02* (2013.01); *F02D 9/04* (2013.01); *F02D 9/10* (2013.01); *F02D 9/14* (2013.01); *F02F 1/186* (2013.01); *F02F 1/22* (2013.01); *F02B 2075/025* (2013.01); *F02B 2720/231* (2013.01); *F02B 2720/236* (2013.01)

(58) Field of Classification Search
CPC ..... F02B 25/08; F02B 25/02; F02B 75/02; F02B 2075/025; F02D 9/02; F02D 9/04; F02D 9/10; F02D 9/14
USPC ..... 123/65 V
See application file for complete search history.

(56) References Cited

U.S. PATENT DOCUMENTS 1,348,672 A 9/1920 Wainwright
2,079,571 A 5/1937 Johnson
(Continued)

FOREIGN PATENT DOCUMENTS

DE 2503514 A1 8/1976
JP 2007327370 A 12/2007

OTHER PUBLICATIONS

European Official Action (dated Jun. 5, 2019) for corresponding European App. 15 908 954.8.
(Continued)

*Primary Examiner* — Joseph J Dallo
*Assistant Examiner* — Yi-Kai Wang
(74) *Attorney, Agent, or Firm* — WRB-IP LLP

(57) ABSTRACT

A uniflow engine includes a cylinder having a cylinder wall, a volume exterior to the cylinder, at least one channel extending between the cylinder wall and the volume, and a valve outside of the cylinder configured to open and close flow communication between the cylinder and the volume through the channel.

18 Claims, 9 Drawing Sheets

(51) Int. Cl.

| | |
|---|---|
| ***F02D 9/10*** | (2006.01) |
| ***F02D 9/14*** | (2006.01) |
| ***F02B 25/04*** | (2006.01) |
| ***F02F 1/22*** | (2006.01) |
| ***F02B 75/28*** | (2006.01) |
| ***F01L 5/06*** | (2006.01) |
| ***F02F 1/18*** | (2006.01) |
| ***F02B 25/02*** | (2006.01) |
| ***F02B 75/02*** | (2006.01) |
| ***F02D 9/02*** | (2006.01) |

(56) References Cited

U.S. PATENT DOCUMENTS 2,440,310 A 4/1948 Thege
2,646,779 A * 7/1953 Fiser ..... F01L 5/06
123/51 BA
2,781,749 A 2/1957 Stucke
3,134,373 A 5/1964 Schauer, Jr.
4,237,831 A 12/1980 Noguchi et al.
4,872,433 A * 10/1989 Paul ..... F02B 23/02
123/257
4,977,857 A 12/1990 Kumagai et al.
5,081,961 A * 1/1992 Paul ..... F01L 1/28
123/190.11
2003/0230258 A1* 12/2003 Niemiz ..... F01L 7/021
123/65 V
2013/0327306 A1* 12/2013 Hooper ..... F01L 7/021
123/65 R

OTHER PUBLICATIONS

International Search Report (dated May 5, 2016) for corresponding International App. PCT/US2015/064021.

* cited by examiner

UNIFLOW ENGINE WITH INTAKE AND/OR EXHAUST VALVES

BACKGROUND AND SUMMARY

The present invention relates generally to uniflow engines and, more particularly, to arrangements for scavenging of such engines.

Two-stroke engines are often categorized by the method by which they achieve gas exchange, i.e., the process of expelling burned gases from a cylinder after combustion and of refilling the cylinder with a fresh charge, e.g. fresh air or a mixture of fresh air and, e.g., fuel. In the field of two-stroke engines, this is called scavenging. Known scavenging designs include cross-, loop-, and uniflow scavenging. Unlike in four-stroke engines, the entire two-stroke scavenging process occurs simultaneously when the piston or pistons are at or near their outermost (bottom dead center) position, and is driven by some external pumping device and not by the motion of the pistons between bottom dead center and top dead center. The filling of a two-stroke cylinder depends on the pressure difference between intake and exhaust ports (valves), how efficiently the in-rushing fresh charge is able to displace the burnt gases from the cylinder without itself exiting the cylinder through the exhaust valves or ports, and how much mass of (mostly) fresh air can be packed into the cylinder by the time that both exhaust and intake ports or valves are closed so that the chamber is sealed.

Regardless of whether the engine is an opposed piston engine or a single piston engine, when the intake is at one end of the cylinder and the exhaust is at the other end, the cylinder and the engine are referred to as having a "uniflow" design or "uniflow scavenged" design. An opposed piston two stroke engine is described herein for purposes of discussion. An opposed piston two stroke engine is a special form of internal combustion engine that includes one, or more cylinder units, each made up of an open cylinder containing two moving pistons, which close off either end of the cylinder, and form a combustion chamber volume between them. Both pistons move in a fixed motion relative to each other and the cylinder so as to create a varying volume between them. This volume forms a combustion chamber. The piston motion is controlled by an external mechanism, most often a slider-crank mechanism, with either two separate cranks held in relative motion by gears or other means, or sharing a single crank. Less commonly, other types of mechanisms, such as a "Scotch yoke" mechanism, are used but the essential operating details here are unchanged. The mechanisms combine the work done by each piston, and convert the linear motion of the pistons to rotational motion, which is the output of the engine. Illustrative structure and operation of opposed piston engines is shown in, for example, U.S. Patent App. Pub. US2013/0036999 which is incorporated by reference.

The innermost position of each piston is referred to as "top center" or "top dead center", and the outermost position is referred to as "bottom center" or "bottom dead center", using slider-crank terminology, regardless of the actual mechanism employed, or the physical orientation of the device. A minimum volume occurs when both pistons are simultaneously at or near their top dead center positions, and a maximum volume occurs then both pistons are simultaneously at or near their bottom dead center positions, if the two pistons are configured so that each reaches top dead center and bottom dead center at the same time, then the minimum and maximum volumes coincide with top dead center and bottom dead center, and the two pistons are said to be "in phase". In the usual case when the two pistons do not achieve top dead center (and bottom dead center) at the same time, then the minimum and maximum volumes occur at approximately the average of the top dead center and bottom dead center, respectively, of each piston, and the pistons are said to be "phased" or "offset" relative to each other.

For a two-stroke engine cycle, the complete cycle, including intake, compression, combustion and exhaust, is completed in one complete motion of the piston from bottom dead center to top dead center and back to bottom dead center, corresponding to one crankshaft revolution. This cycle can be applied to either a positive ignition (spark ignition, or Otto) or a combustion ignition (Diesel) combustion process. The gas exchange process, called "scavenging" in a two-stroke engine, includes expelling (exhausting) the burned gases and relining the cylinder with fresh air (or mixture, if fuel is premixed with the an before entering the cylinder) more or less simultaneously, occurs near bottom dead center, and reduces some of the working stroke of the engine.

The effectiveness of the scavenging process is a critical factor in determining the output of the engine. Usually, either the intake, exhaust or both are through ports (openings in the cylinder wall) near bottom dead center, which are "opened" or "closed" by the piston. While ports are advantageous in allowing a larger flow area than can be accomplished with poppet valves, they have the disadvantage that opening and closing times result from the motion of the piston, and are symmetric about the piston bottom dead center. With an opposed piston engine, both intake and exhaust are through ports, located at opposite ends of the cylinder at maximum volume, each controlled by one of the pistons. This location inherently achieves "uniflow-scavanging", which provides an advantage for optimal scavenging by separating the intake and exhaust as much as possible, thereby reducing mixing of the fresh and burnt gases, but the use of pistons to control both ports creates a difficulty in timing the opening and closing of the ports to also achieve good scavenging.

The inventor has recognized that optimal port for valve) timing requires two conditions: 1) The exhaust should open before the intake, to allow a "blowdown" of the residual pressure in the cylinder to exhaust, so that the cylinder press is approximately the same as, or below the intake manifold pressure at the time of intake opening and 2) the exhaust should close before the intake to allow a build-up of pressure, and therefore more mass, of fresh air in the cylinder above the exhaust manifold pressure (approximately atmospheric).

These two conditions are difficult to achieve in a two-stroke cycle, where a single piston may control both ports. One solution is the single piston "uniflow" design, which uses piston-controlled ports for intake (usually) and poppet valves for exhaust. However, this design requires a valve train system very similar to that of a four-stroke engine, which reduces the potential cost advantage of a two-stroke engine, and the achievable flow area of the poppet valves may restrict the exhaust flow. With an opposed piston engine, both port opening conditions are usually met by "phasing" or "off-setting" the motion of the two pistons relative to each other, retarding the intake relative to the exhaust. This characteristic allows large port areas for both intake and exhaust to allow high gas flow, which is one of the main advantages of the opposed piston design, and is part of the reason for the historically high output of opposed piston engines relative to other engine designs.

When the two pistons of an opposed piston engine are phased relative tee each other, the intake and exhaust processes can be timed for effective scavenging. However, the motion of neither piston is timed relative to the pressure rise in the cylinder from combustion to achieve the same conversion efficiency of the thermodynamic work of the combustion gas into mechanical work of each piston that can be achieved by conventional single piston engines. In most type of piston engines, the highest conversion of work occurs when combustion is tuned so that the maximum pressure occurs at approximately 10-15 degrees after piston top dead center. The reason for this is that a conventional slider-crank mechanism is "locked" at top dead center, and achieves maximum torque when the mechanism is around mid-stroke, and is again "locked" at bottom dead center. When the two pistons of an opposed piston engine are phased, the best combustion timing will be somewhat late for the leading piston, but will be too early for the trailing piston, with a large amount of the pressure rise trying to push that piston in the reverse direction. This results in high torsional vibration, and also significant periods of "negative torque" of the trailing crankshaft during the cycle, which subtracts from the positive torque of the leading crankshaft, resulting in lower than expected engine output.

It is desirable to reduce the efficiency losses due to sub-optimal alignment of piston motion with the combustion pressure rise with an opposed piston engine. It is also desirable to provide a different solution to port timing of opposed piston and single piston uniflow engines in order to achieve the same scavenging performance.

According to an aspect of the present invention, a uniflow engine comprises a cylinder wall, at least one intake port extending between the cylinder wall and the intake air gallery wall and an intake valve outside of the cylinder and configured to open and close flow communication between the cylinder and the intake air gallery through the at least one intake port.

According to another aspect of the present invention, a uniflow engine comprises a cylinder having a cylinder wall, an exhaust gallery having an exhaust gallery wall, at least one exhaust port extending between the cylinder wall and the exhaust gallery wall, an exhaust channel extending from the exhaust gallery, and an exhaust valve configured to open and close the exhaust channel.

According to another aspect of the present invention, a uniflow engine comprises a cylinder having a cylinder wall, a volume exterior to the cylinder, at least one channel extending between the cylinder wall and the volume, and a valve outside of the cylinder configured to open and close flow communication between the cylinder and the volume through the channel.

BRIEF DESCRIPTION OF THE DRAWINGS

The features and advantages of the present invention are well understood by reading the following detailed description in conjunction with the drawings in which like numerals indicate similar elements and in which.

DETAILED DESCRIPTION

Figure 1A:
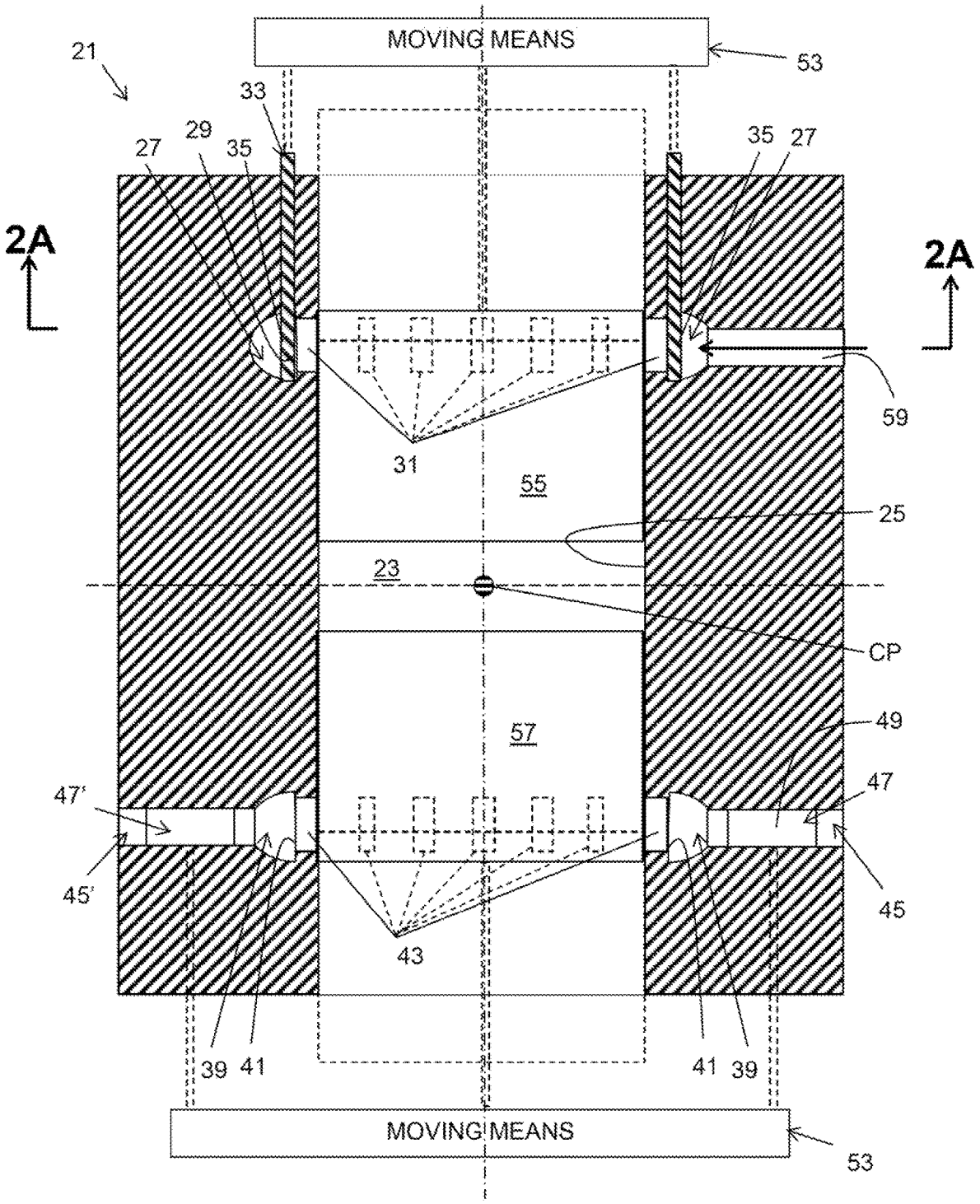
FIG. 1A is a cross-sectional view of an opposed piston uniflow engine according to an aspect of the present invention showing the pistons in a top dead center position.
Figure 1B:
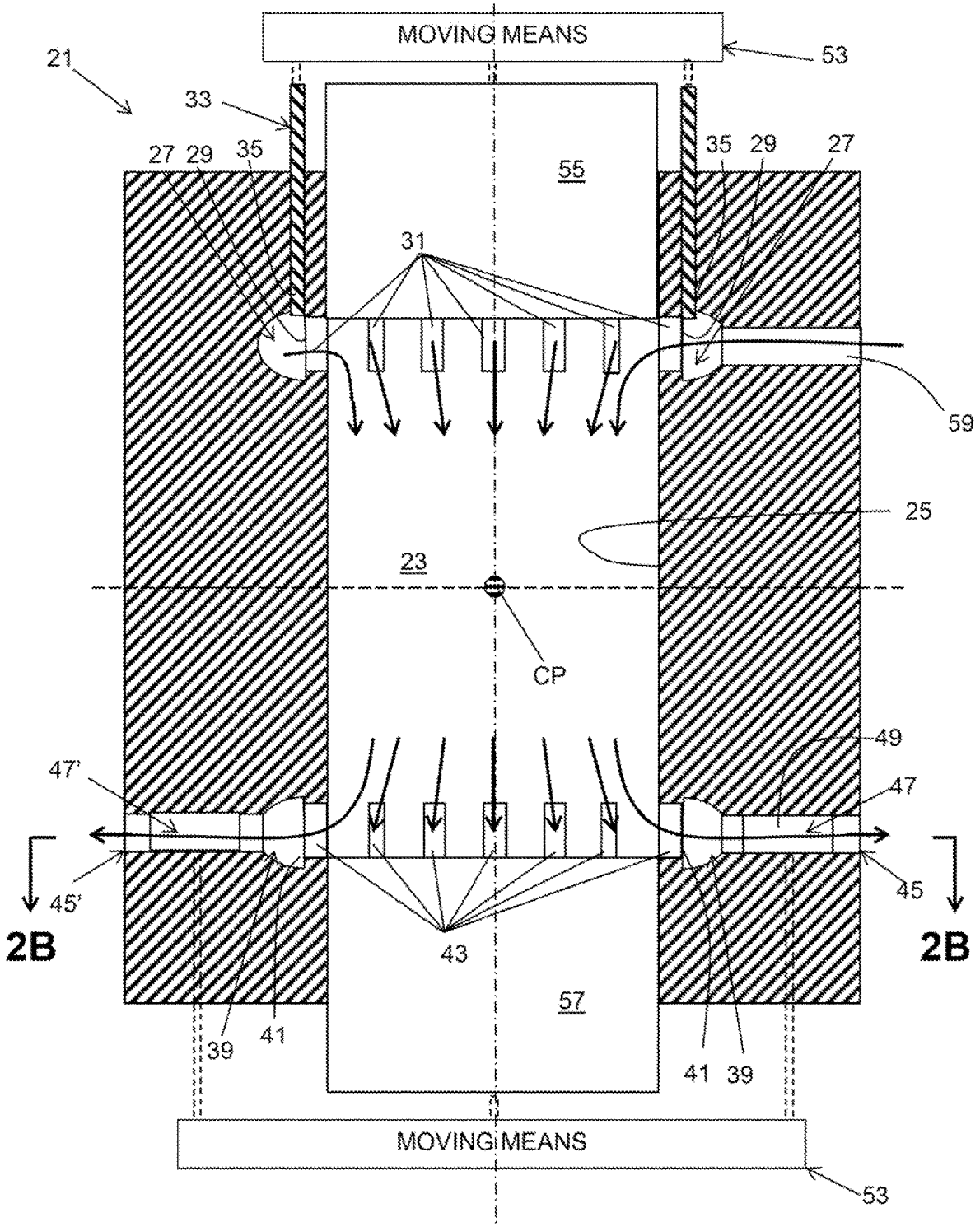
FIG. 1B is a cross-sectional view of the opposed piston uniflow engine of FIG. 1A showing the pistons in a bottom dead center position with two exhaust valves open.
Figure 1C:
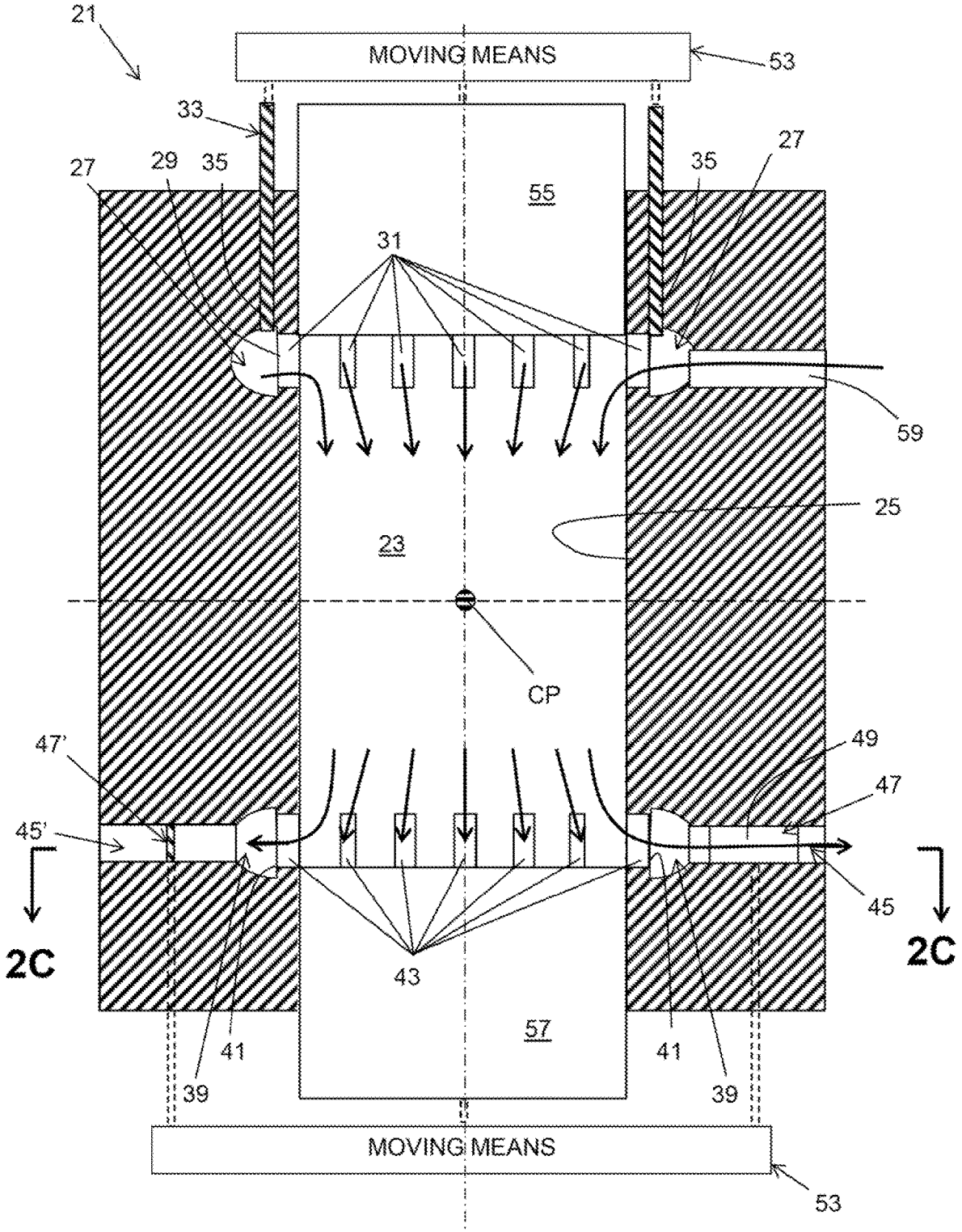
FIG. 1C is a cross-sectional view of the op used piston uniflow engine of FIG. 1A showing the pistons in a bottom dead center position with one exhaust valve open and one exhaust valve closed.
Figure 2A:
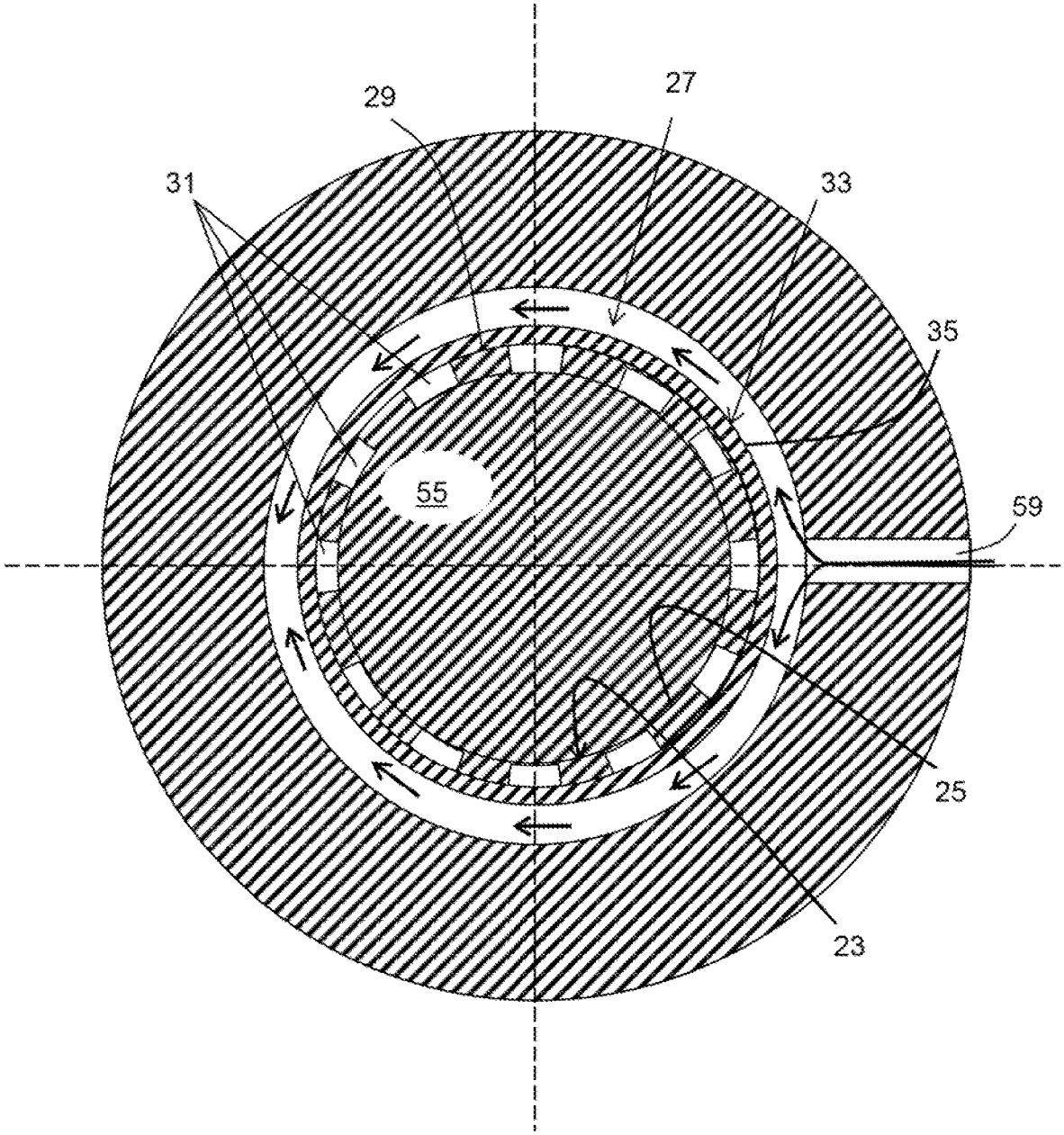
FIG. 2A is a cross-section& view of the opposed piston uniflow engine taken gat section 2A-2A of FIG. 1A.
Figure 2B:
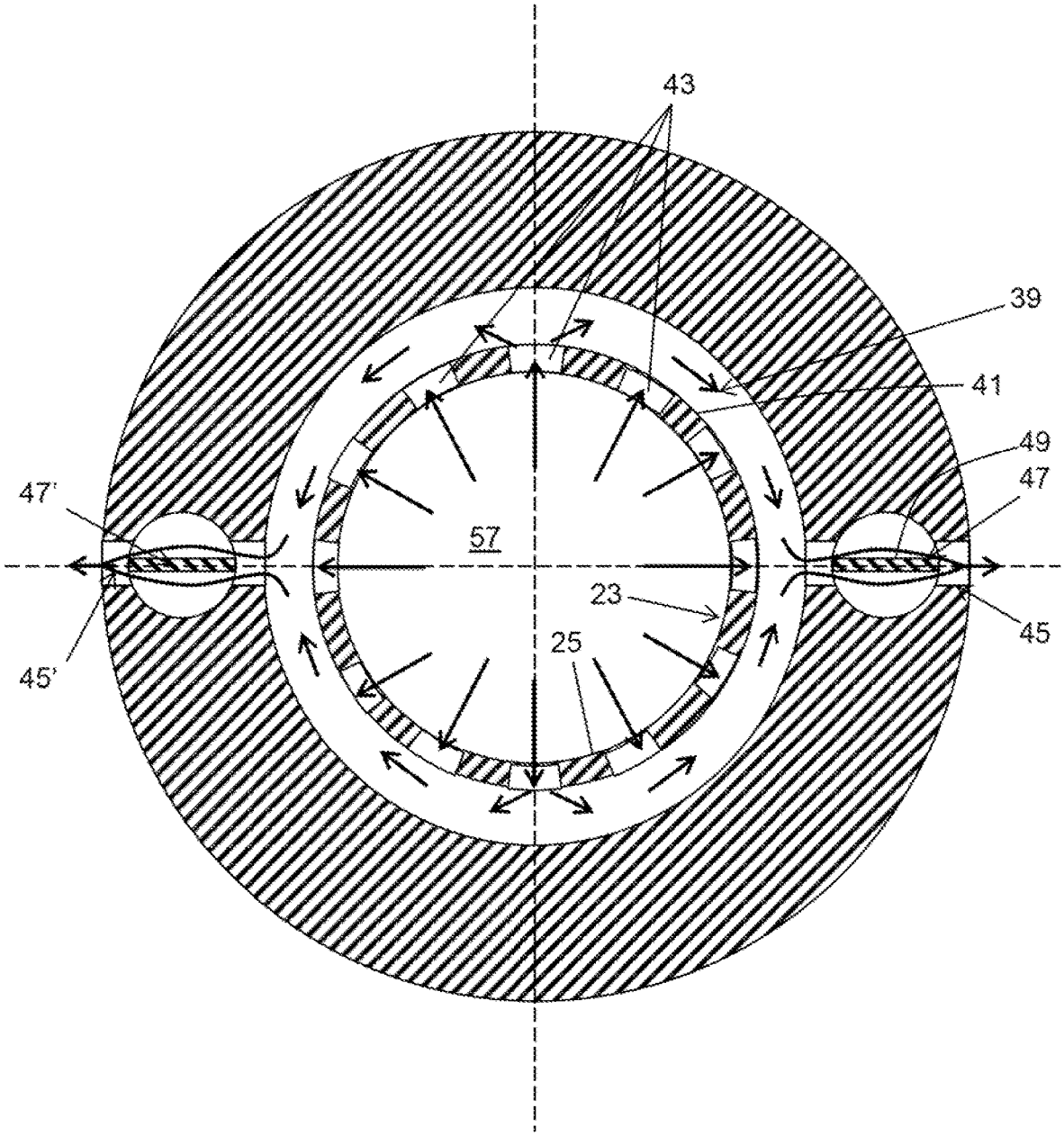
FIG. 2B is a cross-sectional view of the opposed piston uniflow engine taken at section 2B-2B of FIG. 1B.
Figure 2C:
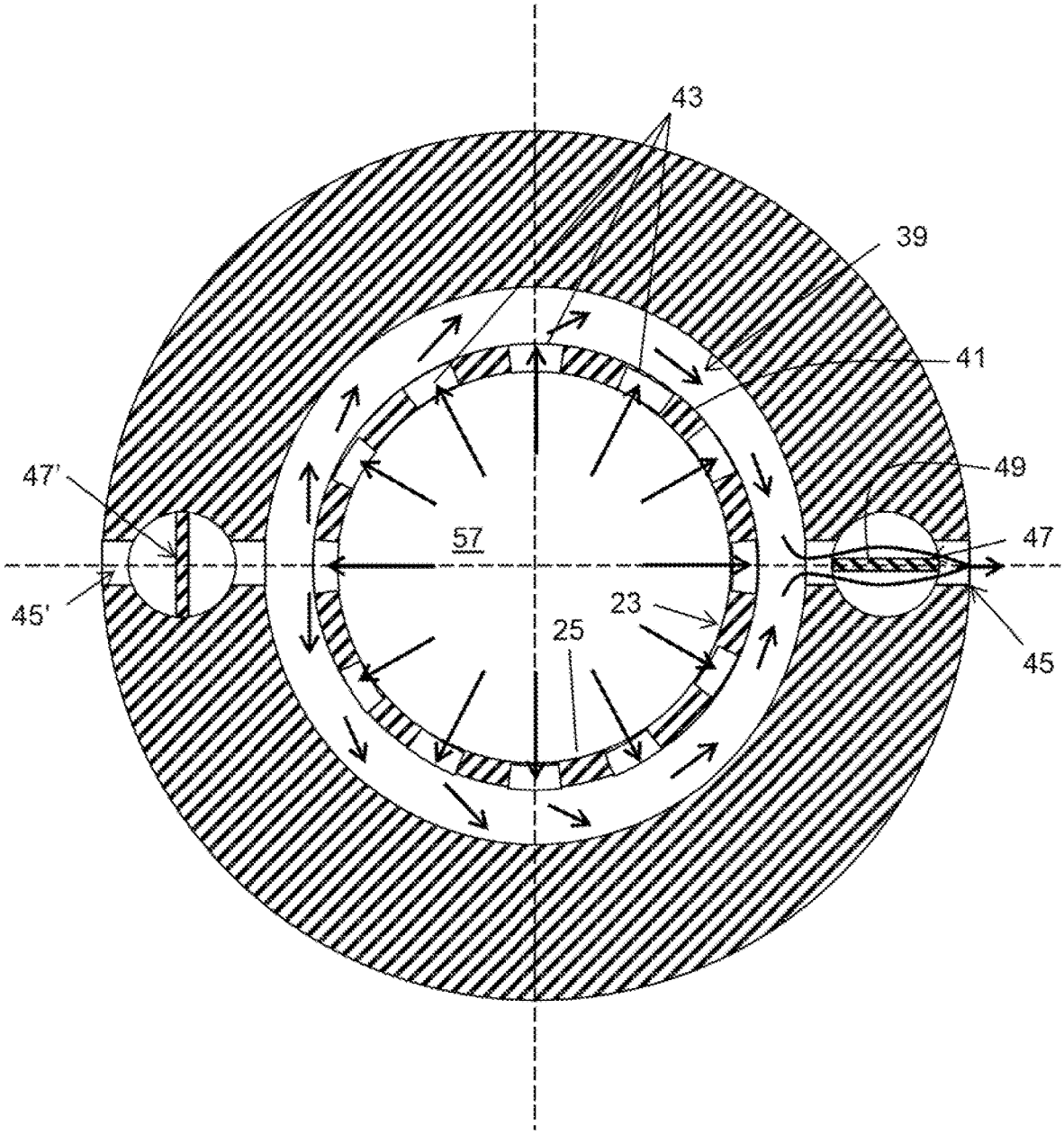
FIG. 2C is a cross-sectional view of the opposed piston uniflow engine taken at section 2C-2C of FIG. 1C.
Figure 2D:
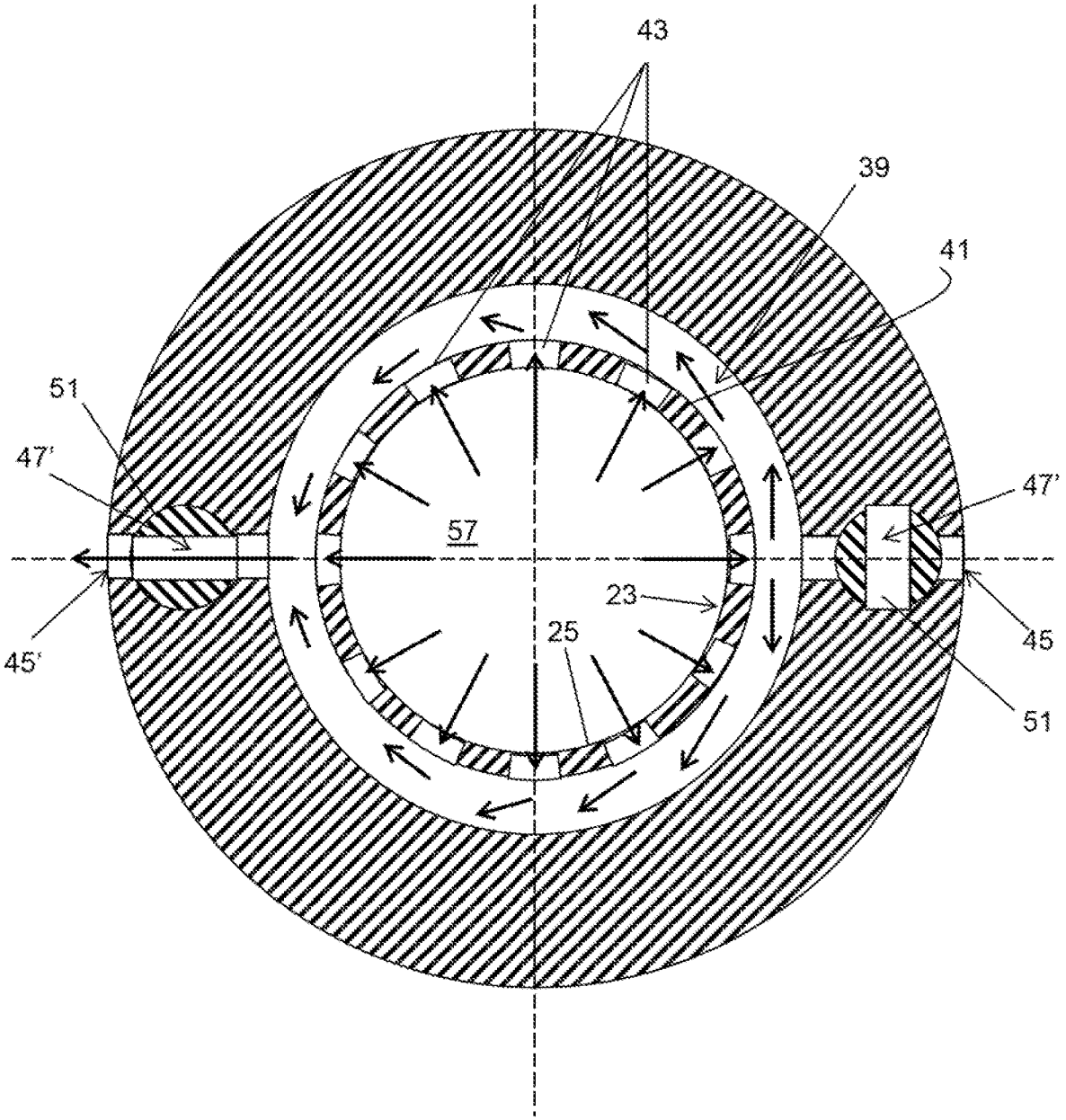
FIG. 2D is a cross-sectional view of an opposed piston uniflow engine according to another aspect of the present invention.

FIGS. 1A-2C show a uniflow engine 21 according to, an aspect of the present invention (FIG. 2D shows a portion of a modified design of a uniflow engine). The illustrated engine 21 is an opposed piston engine and is described for purposes of discussion and to explain features of the invention, however, it will be appreciated that aspects of the invention are also applicable to non-opposed piston, uniflow engines. In general, an engine according to an aspect of the invention comprises a cylinder having a cylinder wall, a volume exterior to the cylinder, at least one channel extending between the cylinder wall and the volume, and a valve outside of the cylinder configured to open and close flow communication between the cylinder and the volume through the channel.

In an aspect of the invention, the engine 21 comprises a cylinder 23 having a cylinder wall 25, an intake air gallery 27, the intake air gallery having an intake air gallery wall 29, at least one intake port 31 extending between the cylinder wall and the intake air gallery wall, and an intake valve 33 outside of the cylinder and configured to open and close flow communication between the cylinder and the intake air gallery through the at least one intake port, and an intake channel 59 through which intake air is supplied to the cylinder.

The intake air gallery 27 is a space that can extend around part of or the entire circumference of the cylinder 23. The engine 21 shown in FIG. 2A (and the engine shown in FIG. 3) has an annular intake air gallery 27 that extends around the entire circumference of the cylinder 23. The intake air gallery 27 can be continuous around an entire circumference of the cylinder 23 as shown in FIG. 2A (and in FIG. 3) or it may be formed as a plurality of discrete volumes (not shown) each extending around part of the circumference of the cylinder, such as is shown in International Application No. PCT/US2014/058103, which is incorporated by reference. In other embodiments (not shown) the intake air gallery can extend around only a portion of the circumference of the cylinder.

While there will be at least one intake port, there will typically be a plurality of intake ports 31 extending between the cylinder wall and the intake air gallery wall. The intake ports 31 can be of the sale size or of different sizes, such as is disclosed in International Application No. PCT/US2014/058103, which is incorporated by reference. The intake ports 31 are illustrated as being substantially rectangular, however, they can have a variety of shapes.

Figure 3:
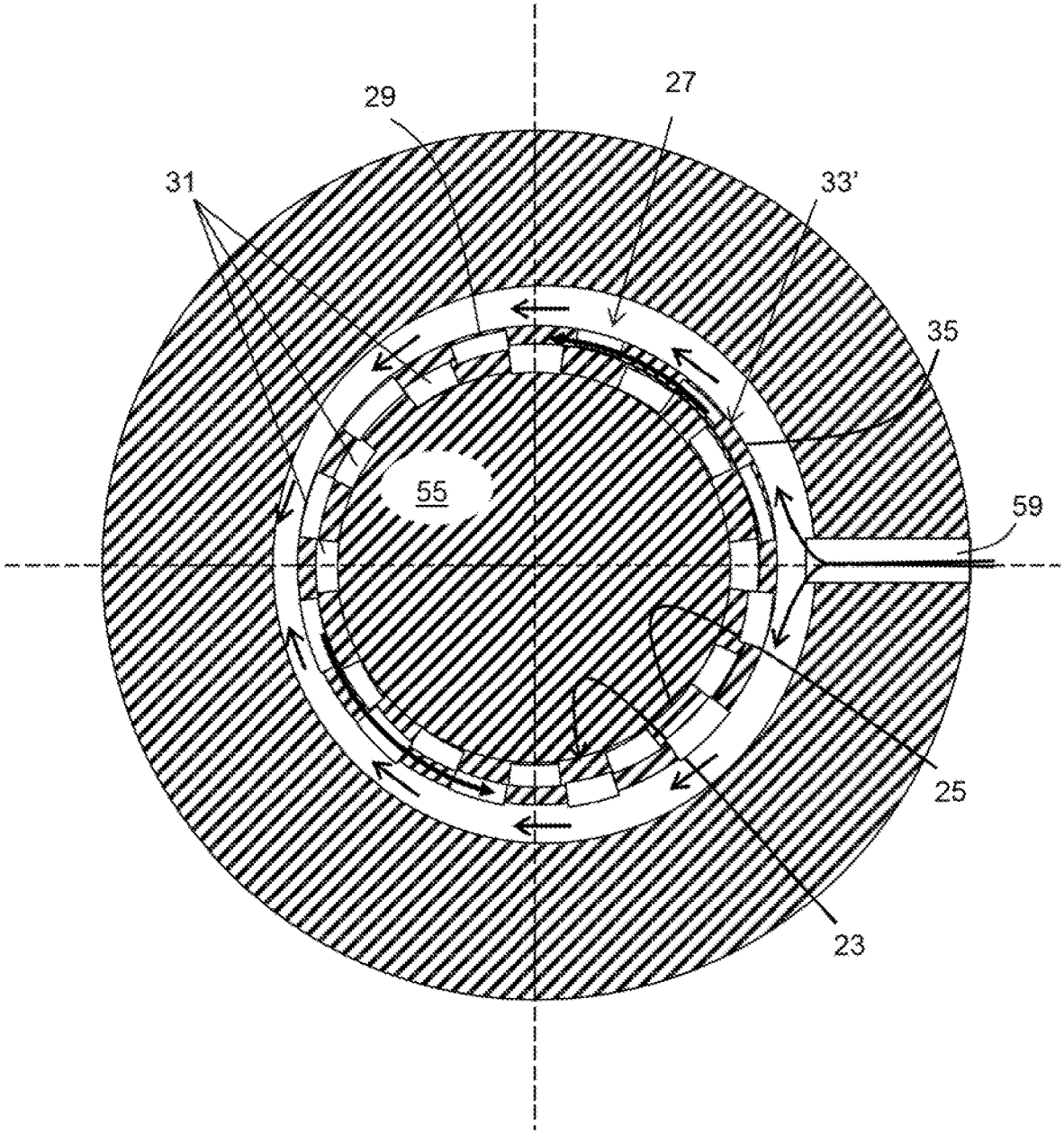
FIG. 3 is a cross-sectional view of a portion of an opposed piston uniflow engine according to still another aspect of the present invention.

The intake valve 33 can take a variety of suitable forms, however, a presently preferred form of valve comprises a cover 35 arranged to reciprocate in a longitudinal direction of the cylinder between a first position (FIGS. 1B and 1C) in which flow communication between the cylinder 23 and the intake air gallery 27 through the at least one intake port 31 is open and a second position (FIG. 1A) in which flow communication between the cylinder and the intake air gallery through the at least one intake port is closed. Where there is a plurality of intake ports 31 extending between the cylinder wall 25 and the intake air gallery wall 29, a presently preferred embodiment of the intake valve 33 is a cover 35 that comprises a tubular sleeve disposed adjacent the intake air gallery wall where the at least one intake port intersects with the gallery wall. Me tubular sleeve/cover 35 can be raised and lowered relative to the intake ports 31 to open and close the ports. Instead of an intake valve 33 in the form of a tubular sleeve, the intake valve may be in the form of a series of discrete covers or gates that can be movable together or individually, to illustrate yet another type of suitable valve. In yet another form of intake valve, the intake valve 33' can be in the torn of a tubular sleeve as seen in FIG. 3, but with slots 33*a* that can be aligned with the intake ports 31 in a first position to open the ports, then rotated slightly to a second position so that the slots align with a solid portion of the intake air gallery wall 29 between the ports 31, such that air flow through the ports 31 is blocked. If the intake air gallery extends around only a portion of the circumference of the cylinder, it may be desirable to use a rotary valve, a butterfly valve, or a plug valve (not shown) in the intake channel 59, however, it will be desirable to keep such valves as close as possible to the cylinder wall 25 to minimize the volume between the intake ports 31 and the valve 33 and, thus, the potential for backflow into the intake air gallery.

It is desirable that the intake valve 33 be disposed so that, when the intake valve is closed, a volume exterior to the cylinder wall 25 is minimized to reduce the possibility of exhaust gas backflowing into the intake air gallery 27 when the intake valve is opened, which can interfere with intake air being introduced to the cylinder and can interfere with scavenging. It is also desirable that the intake valve 33 be disposed close to the cylinder wall 25 to facilitate providing a large volume in the intake air gallery for provision of intake air and minimizing a flow path from the intake air gallery 27 to the cylinder 23 to facilitate scavenging.

The engine 21 can further or alternatively comprise an exhaust gallery 39 having an exhaust gallery wall 41, at least one exhaust port 43 extending, between the cylinder wall and the exhaust gallery wall, an exhaust channel 45 extending, from the exhaust gallery, and an exhaust valve 47 configured to open and close the exhaust channel. The exhaust gallery 39 is a space that can extend around part of or the entire circumference of the cylinder 23. The engine 21 shown in FIG. 2B (and the engines shown in FIGS. 2C, 2D, and 4) has an exhaust gallery 39 that extends around the entire circumference of the cylinder 25 (also shown in portion of engine shown in FIG. 2D). The exhaust gallery 39 can be continuous around an entire circumference of the cylinder 25 or may be formed as a plurality of discrete volumes (not shown) that each extend around part of the circumference of the cylinder. The exhaust channel 45 is illustrated in FIG. 2B (and the exhaust channel 45' is illustrated in FIG. 2D) as a conduit that extends from an annular exhaust gallery 39, however, the exhaust channel can be take different forms, such as being a radially outer part of the annular exhaust gallery. In other embodiments (not shown) the exhaust gallery can extend around only a portion of the circumference of the cylinder.

The exhaust valve 47 can be disposed relative to the cylinder wall 25 to provide a sufficient volume for exhaust gas to expand into after a piston (FIGS. 1A-1C) moves to expose the at least one exhaust port 43 in the cylinder 23 but before the exhaust valve 47 is opened. Ordinarily, the exhaust valve 47 is disposed in an exhaust channel 45 in the form of a conduit leading from the exhaust gallery 39 to an exhaust manifold not shown) so that exhaust gas can expand into the entire exhaust gallery before the exhaust valve is fully opened. On the exhaust side, it is ordinarily desirable for the valve to close before the ports close, causing pressure to back up into the cylinder. It is ordinarily also desirable that the valve open early enough so that the exhaust flow is not initially restricted. The volume of the exhaust gallery will ordinarily allow some expansion that permits the valve to open a bit late, or after the ports open, without unduly restricting flow. Locating the exhaust valve away from the cylinder also protects the valve from excessive heat.

Figure 4:
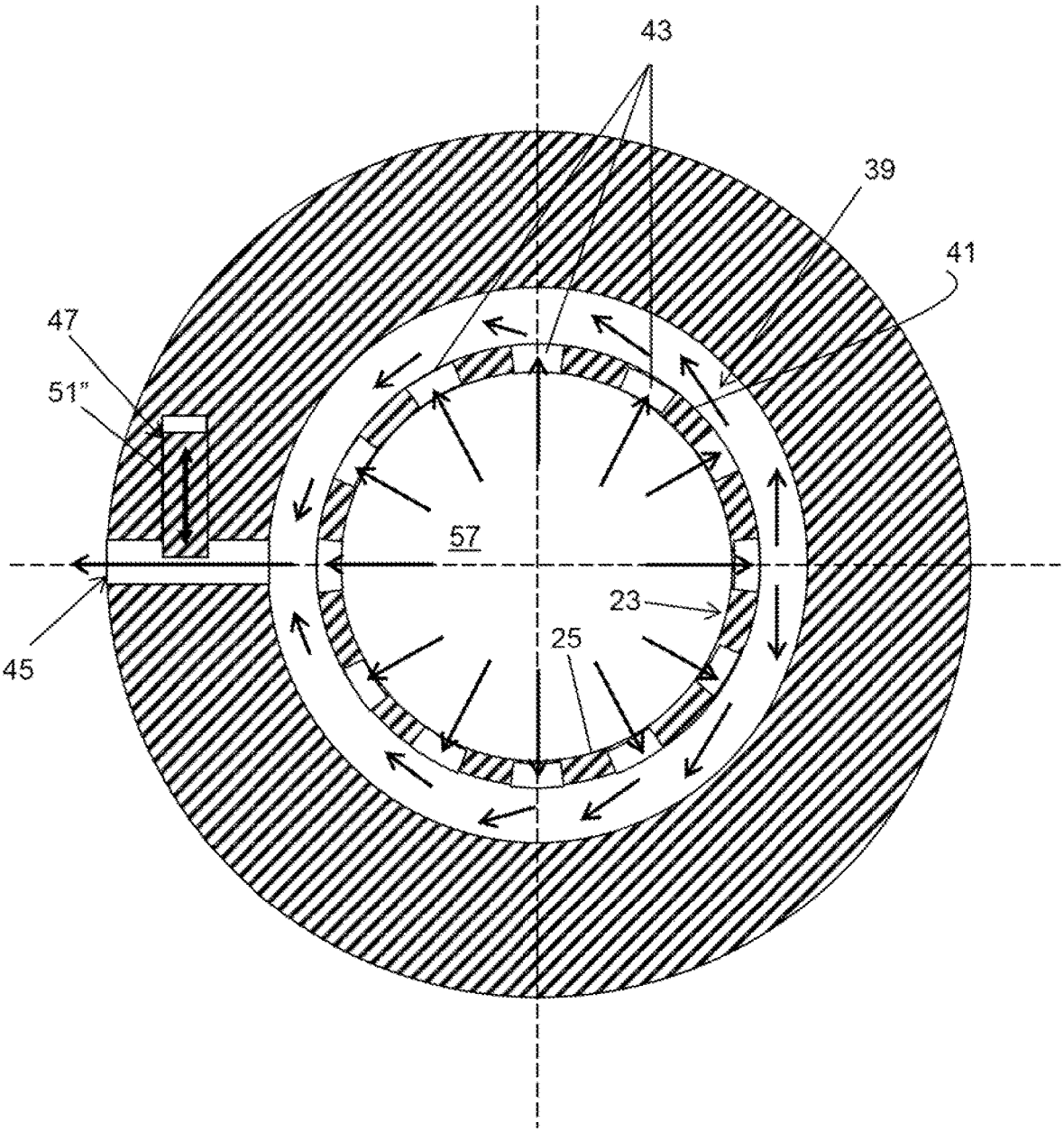
FIG. 4 is a cross-sectional view of a portion of an opposed piston uniflow engine according to yet another aspect of the present invention.

Like the intake valve 33, the exhaust valve 47 can take a variety of suitable forms and may be a reciprocating valve, such as reciprocating tubular sleeve, however, a presently preferred embodiment of the exhaust valve is a rotary valve such as a butterfly valve 49 in an exhaust channel 45 in the form of a conduit extending from an annular exhaust gallery 39 as shown in FIGS. 2B-2C, or a plug valve 51 as shown in FIG. 2D. Other types of valves suitable for use to, e.g., close flow through an exhaust channel 45 in the form of a conduit include reciprocating valves 51' such as gate valves as shown in FIG. 4 and poppet valves that can be moved by various suitable means, such as hydraulic, pneumatic, or mechanical connections (not shown), to further illustrate the range of possible suitable structures.

Means 53 is provided for moving the exhaust valve 47 and the intake valve 33. The movement of the exhaust valve 47 and the intake valve 33 is ordinarily synchronized with movement of opposed pistons 55 and 57 in the cylinder 23 (or movement of a valve is synchronized with movement of the piston in the cylinder for non-opposed piston engines). The moving means may comprise one or more of mechanical linkages, such linkages connected to linkages as shown in U.S. Patent App. Pub. US2013/0036999, which is incorporated by reference, cam arrangements, solenoids, or hydraulic or pneumatic arrangements.

The moving means 53 can move the exhaust valve 47 and the intake valve 33 such that the exhaust valve closes the exhaust channel 45 before the intake valve closes flow communication between the cylinder 23 and the intake air gallery 27. In this way, intake air can continue to enter the cylinder 23 before the pistol 55 closes the intake ports 31 to the cylinder. In addition, the flow of exhaust gas through the exhaust channel 45 is stopped by the closing of the exhaust valve 47, which traps the remaining exhaust gas in either the cylinder 23 or the volume between the cylinder and the exhaust valve. The continuing intake air mass flow with the exhaust restricted causes pressure to build in the cylinder above atmospheric pressure by the time that both intake and exhaust ports are closed. The effective exhaust closing can thus be determined by the exhaust valve 47, before the piston closes the exhaust ports 43. This arrangement can also result in higher compression pressure as the pistons are moved to their top dead center positions (FIG. 1A) in which they are closest to a centerpoint CP of the cylinder 23 because the volume between the exhaust ports 43 and the exhaust valve 47 can be pressurized before the piston 57 seals the exhaust ports instead of having the exhaust merely vent to an exhaust manifold.

The moving means 53 can move the exhaust valve 47 and the intake valve 33 such that the exhaust valve opens the exhaust channel 45 before the intake valve opens flow communication between the cylinder 23 and the intake air gallery 27. In this way, high pressure exhaust gases can begin to exhaust through the exhaust ports 43, exhaust gallery 39, and exhaust channel 45 to the exhaust manifold as soon as the piston 57 exposes the exhaust ports, which may be before or after the piston 55 moves to expose the intake ports 31 but before the intake valve 33 opens, thus reducing pressure in the cylinder and reducing the potential for backflow of exhaust gas into the intake air gallery 27 or one or more conduits 59 leading to the intake air gallery from a source of pressurized air (not shown). Lower pressure in the cylinder 23 when the intake valve 33 opens can facilitate more substantial intake air flow, and can facilitate removal of exhaust gas that remains in the cylinder.

The engine 21 can comprise the first piston 55 that moves in the cylinder 23 between a first piston top dead center position (FIG. 1A) in which the first piston blocks flow communication between the cylinder and the intake air gallery 27 through the at least one intake port 31 and a first piston bottom dead center position (FIGS. 1B and 1C) in which the at least one intake port is exposed and the first piston does not block flow communication between the cylinder and the intake air gallery through the at least one intake port. The engine 21 can further comprise the second piston 57 that moves in the cylinder 23 between a second piston top dead center position (FIG. 1A) in which the second piston blocks flow communication between the cylinder 23 and the exhaust gallery 39 through the at least one exhaust port $3 and a second piston bottom dead center position (FIGS. 1B and 1C) in which the at least one exhaust port is exposed and the second piston does not block flow communication between the cylinder and the exhaust gallery through the at least one exhaust port. The first piston 55 and the second piston 57 will ordinarily be moved by moving means which may be but are not necessarily the same moving means 53 that move the intake and exhaust valves 33 and 47. The moving means for the first piston. 55 and the second piston 57, thus, may comprise one or more of mechanical linkages, such linkages connected to linkages as shoes in U.S. Patent App. Pub. US2013/0036999, which is incorporated by reference, cam arrangements, solenoids, or hydraulic or pneumatic arrangements.

The first piston 55 and the second piston 57 are each closest to the centerpoint CP of the cylinder when the first and second pistons are at the first piston top dead center position yid the second piston top dead center position, respectively. A distance of the at least one intake port 31 from the centerpoint CP can be different from a distance of the at least one exhaust port 43 from the centerpoint. The distance of the at least one intake port 31 from the centerpoint CP may be greater than the distance of the at least one exhaust port 43 from the centerpoint so that, during, the expansion/exhaust stroke, the in least one exhaust port 43 will be exposed by the piston 57 before the at least one intake port is exposed by the piston, facilitating exhaust of exhaust gas before the intake ports are exposed. Alternatively, the distance of the at least one intake port 31 from the centerpoint CP may be less than the distance of the at least one exhaust port 43 from the centerpoint so that, during an intake/compression stroke, intake air can continue to enter the cylinder 23 after the piston 57 has closed the at least one exhaust port and before the piston 55 closes the at least one intake port.

The moving means 53 can move the first piston 55 and the intake valve 33 so that flow communication between the cylinder 23 and the intake air gallery 27 through the at least one intake port 31 is blocked by the intake valve 33 for at least a portion of a movement of the piston toward the bottom dead center position after the movement of the piston at least partially exposes the at least one intake port (as shown in phantom in FIG. 1A). The moving means 53 can move the second piston 57 and the exhaust valve 47 so that exhaust can flow through from the cylinder 23 when the second piston 57 moves toward bottom dead center and at least partially uncovers the at least one exhaust port 3, through the exhaust gallery 39, pas the exhaust valve 49, and out the exhaust channel 45. The moving means 53 can move the second piston 57 and the exhaust valve 47 so that flow through the exhaust channel 45 is blocked by the exhaust valve 47 before the second piston 47 moves inward from its bottom dead center position (FIGS. 1B and 1C) far enough to close the at least one exhaust port 43 so that flow of exhaust from the cylinder is stopped by closure of the valve 47. As also seen in FIG. 1C, the moving means 53 can move the exhaust valve 47 so that the exhaust channel 45 is open white the first piston 55 does not block flow communication between the cylinder 23 and the intake air gallery 27 through the at least one intake port 31 and so that the exhaust channel is closed before first piston blocks flow communication between the cylinder and the intake air gallery through the at least one intake port.

FIGS. 2B-2D show that the engine 21 can comprise at least one second exhaust port 43 extending between the cylinder wall and the exhaust gallery wall 41, a second exhaust channel 45' extending from the exhaust gallery 39, and a second exhaust valve 47' configured to open and close the second exhaust channel. There may, alternatively, be only a single exhaust port 43 and exhaust channel 45 as shown in FIG. 4, or more than two ports and channels. As seen in FIGS. 1C and 2C, the moving means can move the exhaust valve 47 and the second exhaust valve 47' so that the exhaust valve closes the exhaust channel 45 at a different time than the second exhaust valve closes the second exhaust channel 45'. In this way, desired air flow patterns may be achieved. Similarly, the moving means 53 can move the exhaust valve 47 and the second exhaust valve 47' so that the exhaust valve opens the exhaust channel 45 at a different time than the second exhaust valve opens the second exhaust channel 45'.

By providing ogre or more of intake valves and exhaust valves in a uniflow engine, the timing of the opening of the intake and exhaust ports can be independent of the position of the piston or pistons in the cylinder, thus facilitating obtaining increased efficiency from uniflow engines. In addition, by making the timing of the opening of the intake and exhaust ports independent of the position of the piston or pistons in the cylinder, scavenging can be improved.

In the present application, the use of terms such as "including" is open-ended and is intended to have the same meaning as terms such as "comprising" and not preclude the presence of other structure, material, or acts. Similarly, though the use of terms such as "can" or "may" is intended to be open-ended and to reflect that structure, material, or acts are not necessary, the failure to use such terms is not intended to reflect that structure, material, or acts are essential. To the extent that structure, material, or acts are presently considered to be essential, they are identified as such.

While this invention has been illustrated and described in accordance with a preferred embodiment, it is recognized that variations and changes may be made therein without departing from the invention as set forth in the claims.

The invention claimed is:

1. A uniflow engine, comprising:

a cylinder having a cylinder wall;

an intake air gallery, the intake air gallery having an intake air gallery wall;

at least one intake port extending between the cylinder wall and the intake air gallery wall;

an intake valve outside of the cylinder and configured to open and close flow communication between the cylinder and the intake air gallery through the at least one intake port;

an exhaust gallery having an exhaust gallery wall;

at least one, exhaust port extending between the cylinder wall and the exhaust gallery wall, an exhaust channel extending from the exhaust gallery;

an exhaust valve configured to open and close the exhaust channel;

at least one second exhaust port extending between the cylinder wall and the exhaust gallery wall, a second exhaust channel extending from the exhaust gallery; and a second exhaust valve configured to open and close the second exhaust channel.

2. The uniflow engine as set forth in claim 1, wherein the intake valve comprises a cover arranged to reciprocate in a longitudinal direction of the cylinder between a first position in which flow communication between the cylinder and the intake air gallery through the at least one intake port is open and a second position in which flow communication between the cylinder and the intake air gallery through the at least one intake port is closed.

3. The uniflow engine as set forth in claim 2, wherein the cover comprises a tubular portion disposed adjacent the intake air gallery wall.

4. The uniflow engine, as set forth in claim 1, wherein the intake valve comprises a cover with at least one cover opening, the cover being adapted to rotate relative to the cylinder to a first position in which the at least one cover opening is aligned with the at least one intake port and flow communication between the cylinder and the intake air gallery is open, and a second position in which flow communication between the cylinder and the intake air gallery is closed.

5. The uniflow engine as set forth in claim 1, comprising a plurality of intake ports extending between the cylinder wall and the intake air gallery wall.

6. The uniflow engine as set forth in claim 1, wherein the exhaust valve is a rotary valve.

7. The uniflow engine as set forth in claim 1, comprising means for moving the exhaust valve and the intake valve such that the exhaust valve closes the exhaust channel before the intake valve closes flow communication between the cylinder and the intake air gallery.

8. The uniflow engine as set forth in claim 7, wherein the moving means moves the exhaust valve and the intake valve such that the exhaust valve opens the exhaust channel before the intake valve opens flow communication between the cylinder and the intake air gallery.

9. The uniflow engine as set forth in claim 1, comprising means for moving the exhaust valve and the intake valve such that the exhaust valve opens the exhaust channel before the intake valve opens flow communication between the cylinder and the intake air gallery.

10. The mallow engine as set forth in claim 1, comprising, a first piston that moves in the cylinder between a first piston top dead center position in which the first piston blocks flow communication between the cylinder and the intake air gallery through the at least one intake port and a first piston bottom dead center position in which the at least one intake port is exposed and the first piston does not block flow communication between the cylinder and the intake air gallery through the at least one intake port, and a second piston that moves in the cylinder between a second piston top dead center position in which the second piston blocks flow communication between the cylinder and the exhaust gallery through the at least one exhaust port and a second piston bottom dead center position in which the at least one exhaust port is exposed and the second piston does not block flow communication between the cylinder and the exhaust gallery through the at least one exhaust port, wherein the first piston and the second piston are each closest to a centerpoint of the cylinder when the first and second pistons are at the first piston top dead center position and the second piston top dead center position, respectively, and a distance of the at least one intake port from the centerpoint is different from a distance of the at least one exhaust port from the centerpoint.

11. The uniflow engine as set forth in claim 1, comprising a piston that moves in the cylinder between a top dead center position in which the first piston blocks flow communication between the cylinder and the intake air gallery through the at least one intake port and a bottom dead center position in which the at least one intake port is exposed and the piston does not block flow communication between the cylinder and the intake air gallery through the at least one intake port, and means for moving the intake valve so that flow communication between the cylinder and the intake air gallery through the at least one intake port is blocked by the intake valve for at least a portion of a movement of the piston toward the bottom dead center position after the movement of the piston at least partially exposes the at least one intake port.

12. A uniflow engine, comprising:

a cylinder having a cylinder wall;

an exhaust gallery having an exhaust gallery wall;

at least one exhaust port extending between the cylinder wall and the exhaust gallery wall;

an exhaust channel extending from the exhaust gallery;

an exhaust valve configured to open and close the exhaust channel; and at least one second exhaust port extending between the cylinder wall and the exhaust gallery wall, a second exhaust channel extending from the exhaust gallery, and a second exhaust valve configured to open and close the second exhaust channel.

13. The uniflow engine as set forth in claim 12, wherein the exhaust valve is a rotary valve.

14. The uniflow engine as set forth in claim 12, wherein the exhaust valve is a reciprocating valve.

15. The uniflow engine as set forth in claim 12, comprising means for moving the exhaust valve and the second exhaust valve so that the exhaust valve closes the exhaust channel at a different time than the second exhaust valve closes the second exhaust channel.

16. The uniflow engine as set forth in claim 15, wherein the moving means moves the exhaust valve and the second exhaust valve so that the exhaust valve opens the exhaust channel at a different time than the second exhaust valve opens the second exhaust channel.

17. The uniflow engine as set forth in claim 12, comprising means for moving the exhaust valve and the second exhaust valve so that the exhaust valve closes the exhaust channel at a different time than the second exhaust valve closes the second exhaust channel.

18. The uniflow engine as set forth in claim 12, comprising an intake air gallery, the intake air gallery having an intake air gallery wall, at least one intake port extending between the cylinder wall and the intake air gallery wall, a piston that moves in the cylinder between a top dead center position in which the piston blocks flow communication between the cylinder and the intake air gallery through the at least one intake port and a bottom dead center position in which the at least one intake port is exposed and the piston does not block flow communication between the cylinder and the intake air gallery through the at least one intake port, and means for moving the exhaust valve so that the exhaust channel is open while the piston does not block flow communication between the cylinder and the intake air gallery through the at least one intake port and so that the exhaust channel is closed before piston blocks flow communication between the cylinder and the intake air gallery through the at least one intake port.

* * * * *